US007707957B1

(12) United States Patent
Dudt et al.

(10) Patent No.: US 7,707,957 B1
(45) Date of Patent: May 4, 2010

(54) STRUCTURAL SUPPORT TO UNDERWATER VESSELS USING SHAPE MEMORY ALLOYS

(75) Inventors: Philip John Dudt, Rockville, MD (US); Joseph P. Teter, Darnestown, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 305 days.

(21) Appl. No.: 11/700,966

(22) Filed: Jan. 23, 2007

(51) Int. Cl.
*B63G 8/00* (2006.01)

(52) U.S. Cl. ..... 114/312; 114/341

(58) Field of Classification Search ..... 114/341, 114/356, 312, 342; 29/447; 285/381.2
See application file for complete search history.

(56) References Cited

U.S. PATENT DOCUMENTS 6,865,791 B2 * 3/2005 Cook et al. ..... 29/447

* cited by examiner

*Primary Examiner*—Ed Swinehart
(74) *Attorney, Agent, or Firm*—Dave A. Ghatt

(57) ABSTRACT

A supporting arrangement for a vessel for counteracting compressive loads at an operating temperature. The supporting arrangement also provides inertial stiffening of the hull of the vessel as well as acoustic and vibration damping. The supporting arrangement includes a support structure that is made from a shape memory alloy that contacts and presses against the inner walls of the vessel. The supporting arrangement utilizes the shape recovery properties and/or the internal energy properties of the shape memory alloy support structure to provide reinforcing and damping forces.

8 Claims, 4 Drawing Sheets

FIG. 1A
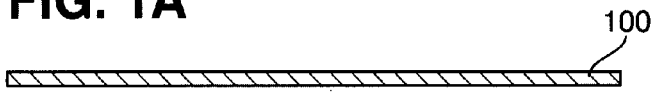
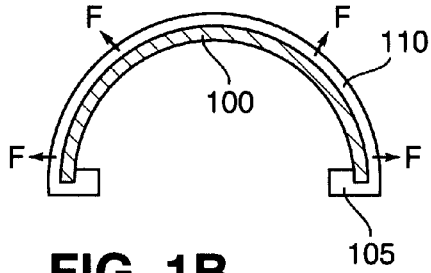
FIG. 1B
FIG. 2
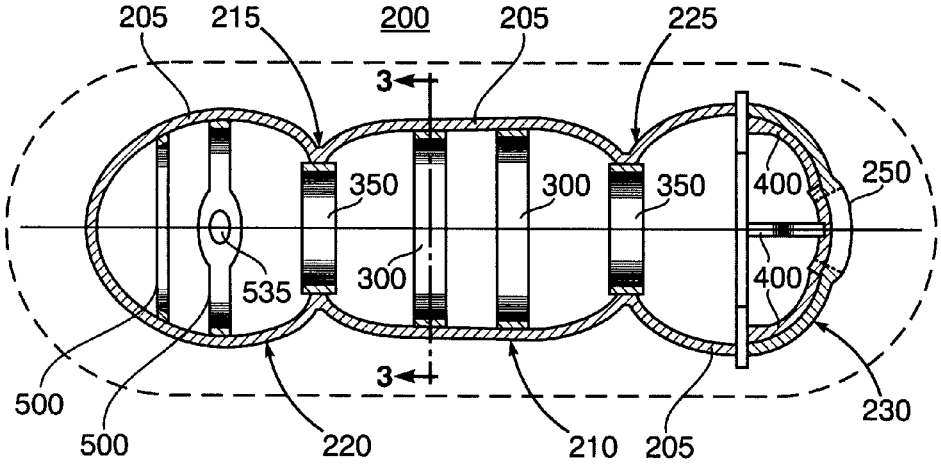

STRUCTURAL SUPPORT TO UNDERWATER VESSELS USING SHAPE MEMORY ALLOYS

STATEMENT OF GOVERNMENT INTEREST

The invention described herein may be manufactured and used by or for the Government of the United States of America for governmental purposes without the payment of any royalties thereon or therefore.

FIELD OF THE INVENTION

The present invention relates generally to a structure for reinforcing supporting structures in vessels that experience amplified pressures, more particularly the invention is directed to the use of shape memory alloys as reinforcement support against increased hydrostatic pressures experienced by underwater vessels.

BACKGROUND OF THE INVENTION

Submersible vehicles are used in a variety of naval and civilian activities. Submersible vehicles undergo increasing hydrostatic pressures as they submerge into the ocean. To resist high pressures, the hulls of submersible vehicles are typically constructed from surface-of-revolution shapes, i.e., spherical shells, cylinders, and spheroids, with these shapes being typically compartmentalized and often reinforced.

In spite of the use of shapes and conventional reinforcement structures that accommodate for increased hydrostatic pressures, ship hulls still experience high stress levels. The high levels of stress concentration are experienced on internal surfaces at junctures where spherical and/or cylindrical compartments are combined. When compartments are joined there typically is a transition area between the compartments. These transition areas must allow for these high stress levels. Another area where stresses are increased is around view ports and other penetrations, which require built up areas to sustain the higher stress. For depths of about 5000 to 25,000 ft, thick-walled spherical and cylindrical shapes are typically employed for resisting extreme pressures. Generally, materials of high strength-to-weight ratios are utilized. It is desired to have arrangements that more efficiently accommodate for these high pressures, for example, arrangements that incorporate frames of reduced thicknesses and weight. Submersible vehicles may also be subjected to shock and vibration. It is also desired to have arrangements that dissipate the detrimental effects of shock and vibration.

SUMMARY OF THE INVENTION

The present invention addresses aspects of problems outlined above. Preferred embodiments of the present invention provide an arrangement for providing structural support for underwater vessels.

In one aspect, the invention is a supporting arrangement for counteracting compressive loads at an operating temperature. According to the invention, the arrangement includes a vessel shell having an enclosed inner wall portion. The supporting arrangement further includes a support structure for exerting an outward pressing force on the vessel shell at the operating temperature. The support structure comprises a shape memory alloy having an original configuration at an operating temperature and an altered configuration at a reduced temperature. The support structure contacts the enclosed inner wall portion of the vessel shell.

In another aspect, the invention is an underwater vessel supporting arrangement for counteracting compressive loads at an operating temperature. In this aspect, the arrangement includes a vessel shell having an enclosed inner wall portion. The underwater vessel supporting arrangement further includes one or more support structures. The one or more support structures are for exerting an outward pressing force on the vessel shell at the operating temperature. Each of the one or more support structures comprises a shape memory alloy having an original substantially linear shape, at the operating temperature, and an altered shape at a reduced temperature. Each of the one or more support structures contacts the enclosed inner wall portion of the vessel shell. According to this aspect, at the operating temperature, each of the one or more support structures is restricted to the altered shape by the inner wall portion of the vessel shell. The vessel shell prevents the recovery to the original substantially linear shape. This results in each of the restricted support structures exerting the outward pressing force on the vessel shell.

BRIEF DESCRIPTION OF DRAWINGS

A more complete appreciation of the invention and many of its attendant advantages will be readily appreciated as the same becomes better understood by reference to the following detailed description when considered in connection with the accompanying drawing wherein:

FIG. 1A is an explanatory illustration showing the original orientation of a support structure according to an embodiment of the present invention;

FIG. 1B is an explanatory illustration showing the general operation of a supporting arrangement according to an embodiment of the present invention;

FIG. 2 is a longitudinal sectional view of a supporting arrangement in accordance with an embodiment of the present invention;

DETAILED DESCRIPTION

Figure 3A:
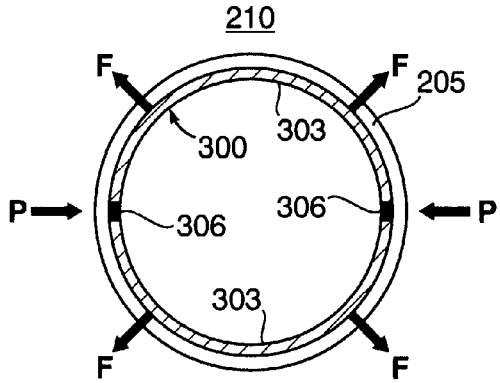
FIG. 3A is a sectional view through line 3-3 in FIG. 2, showing a supporting arrangement in accordance with an embodiment of the present invention.

FIGS. 1A and 1B are explanatory illustrations showing the general operation of a supporting arrangement according to an embodiment of the present invention. FIG. 1A shows a support structure 100 in an original substantially linear shape. FIG. 1B also shows the same support structure 100 bent in an arc-like configuration.

The support structure 100 is formed from a shape memory alloy. As will be highlighted throughout the disclosure, in the present invention shape memory alloys are used as support structures because of advantages associated with the alloys' three common physical states of existence, the martensitic state, the austenitic state, and the superelastic state. The martensitic state occurs at a reduced temperature. At this reduced temperature, the shape memory alloy is bendable or distortable, has the ability to absorb large amounts of energy, and is extremely resistant to fatigue. The austenitic state occurs at an elevated temperature, as compared to the martensitic state. In the austenitic state, shape memory alloys attempt to revert to the shape they held before being altered during the martensitic state. The superelastic state occurs at higher temperatures than required to enter the austenitic state. In the superelastic state, the shape memory alloy also attempts to recover its former shape. Additionally, in this state the shape memory alloys exhibit spring-like qualities, with the capability to withstand large stresses, and spring back to the original shape.

Returning to FIGS. 1A and 1B, the support structure 100 is anchored at 105 against a restraint 110. The originally substantially linear support structure 100 is mechanically worked into an arc-like configuration. The working process includes cooling the support structure 100 so that it enters into a martensitic state. The support structure 100 is subsequently heated to enter into an austenitic state, wherein the support structure would typically assume its original shape, i.e., a substantially linear shape as shown in FIG. 1A. However, as shown in FIG. 1B, the support structure 100 is wedged behind a restraint 110. Consequently, the support structure is constrained from returning to its original shape. This results in a force F being produced against the restraint 110. According to an embodiment of this invention, the force F associated with the shape recovery as illustrated in FIGS. 1A and 1B is used to provide internal strengthening in submersible vessels.

FIG. 2 is a longitudinal sectional view of a supporting arrangement in accordance with an embodiment of the present invention. FIG. 2 shows a submersible vessel 200, such as a submarine, having a vessel shell 205 forming the general frame of the vessel. The vessel shell 205 comprises several different compartments, including a substantially cylindrical compartment 210, and two substantially spherical compartments 220 and 230. Compartments 210 and 220 are connected at a transition area 215. Compartments 210 and 230 are connected at a transition area 225. Although FIG. 2 illustrates one substantially cylindrical compartment and two substantially spherical compartments, the vessel 200 may include a plurality of substantially cylindrical compartments and/or spherical compartments, and combinations thereof, connected at transition areas.

FIG. 2 also shows support structures 300 within the substantially cylindrical compartment 210. Substantially spherical compartment 220 also includes support structures 500. The support structures 500 may also include an opening that encompasses a viewport 535. FIG. 2 also shows support structures 350 located at transition regions 215 and 225. The support structures 300, 350, and 500 are typically ring-shaped bands. These bands are shape memory alloy bands that form a complete 360 degree circular ring-shaped band. Compartment 230 has support structures 400, which are also formed from shape memory alloys. However, supports 230 are arc-shaped bands and do not complete a full 360 degree circle. The support structures 400 are positioned to provide reinforcement around the viewport 250. It should be noted that the invention is not limited by the number of support structures (300, 350, 400, 500) illustrated in the compartments depicted in FIG. 2. For example, compartment 210 shows two support structures. However, compartment 210 may include one, two, or more support structures 300 laterally spaced within the compartment.

FIG. 3A is a sectional view of compartment 210, through section line 3-3 in FIG. 2. FIG. 3A shows the vessel shell 205 having a substantially circular cross section. Support structure 300 is wedged inside the shell against an enclosed inner wall portion. Support structure is formed from substantially linear strips 303 of shape memory alloy. The shape memory alloy strips 303 are cooled to a reduced temperature to enter a martensitic state. The strips are then worked into arc-shaped bands that are concordant with the inner walls of the vessel shell 205. These strips are lined-up in an end-to-end configuration against the inner wall of the vessel shell 205 so as to form the ring-shaped band. The strips may be joined at their ends 306 using known procedures, such as end-to-end brazing or soldering. Alternatively, the strips may be maintained in the end-to-end configuration without physically attaching them together. The ends of the strips may be held in place by anchors on the shell. Alternatively, the anchoring of the ends may not be necessary. Strips may maintain a particular position by virtue of the force-fit within the shell. It should be noted that even though FIG. 3A shows only two strips, the ring-shaped band may be formed from three or more strips aligned in end-to-end configuration, which may or may not be attached as outlined above. Alternatively, a single strip may be worked into a complete circular band.

As outlined above, the ring-shaped band is formed from substantially linear strips of shape memory alloy strip. Each strip is processed at a reduced temperature. After the ring-shaped band is assembled in the vessel shell 205 at the reduced temperature, the structure is heated to an appropriate temperature to enter an austenitic state. In the austenitic state each strip attempts to assume its original shape, i.e., a substantially linear shape as shown in FIG. 1A. The appropriate temperature is typically the operating temperature, i.e., the temperature at which the submersible vessel typically operates, and the actual heating-up of the strips may be accomplished merely by contact with the vessel shell. The temperature at which the shape memory alloy remembers its high temperature form can be adjusted by slight changes in the composition of the alloy and through heat treatment. For example, in nickel-titanium shape memory alloys, the composition can be manipulated to control the progression into the austenitic state at any desired temperature in a range from about 100° C. to about −100° C.

Because the ring-shaped band and its constituent strip or strips are wedged behind the vessel shell 205, the strips of the ring-shaped band are constrained from returning to their original shape. In an attempt to recapture its original shape the ring-shaped band exerts an outward pressing force F against the vessel shell 205. As shown in FIG. 3A, this outward pressing force F counteracts the external hydrostatic pressure P, which is generated as a function of the depth of the vessel below the water. The force F generated against the vessel shell 205 allows the vessel to go deeper because some of the hydrostatic loads are counteracted by the tensile shape memory generated forces. The ring-shaped band and its constituent strips also provide inertial stiffening to the vessel shell. Additionally, the supporting arrangement which includes the ring-shaped band, improves creep and fatigue strength by counteracting the hydrostatic loads.

Figure 3B:
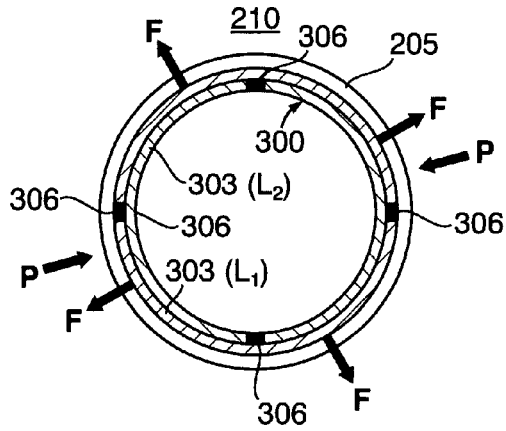
FIG. 3B is a sectional view through line 3-3 in FIG. 2, showing a supporting arrangement in accordance with another embodiment of the present invention.

FIG. 3B is a sectional view of compartment 210, through section line 3-3 in FIG. 2, showing an alternative configuration for the support section. FIG. 3B shows the support structure 300 in the form of a ring-shaped band. The ring-shaped band is multi-layered, with one or more strips 303 of shape memory alloy forming each layer. The strips may be joined at their ends 306 using known procedures, or alternatively, the strips may be maintained in the end-to-end configuration as described with respect to FIG. 3A. The layers may be assembled in an overlapping manner that may be staggered, as shown in FIG. 3B. FIG. 3B shows two layers of strips ($L_1$ and $L_2$), however, this embodiment may include as many layers as desired ($L_1, L_2 \ldots L_n$).

Similar to the above example, each strip in the multiple layered supporting structure assembly is processed at a reduced temperature, assembled in the vessel shell, heated to an operating temperature, after which each strip attempts to assume its original shape. In the attempt to recapture the original shape the ring-shaped band exerts an outward pressing force F against the vessel shell 205. In this embodiment, the outward pressing force F may be further tailored to specific applications by utilizing shape memory alloy strips of different properties in the ring-shaped band. For example, in areas of the shell where more resistance is desired, an alloy strip with greater stiffness may be employed in the specific area that requires that increased resistance. This functionally graded arrangement has the benefit of reducing shock resistance and improving fatigue and creep performance in the submersible vessel.

Figure 3C:
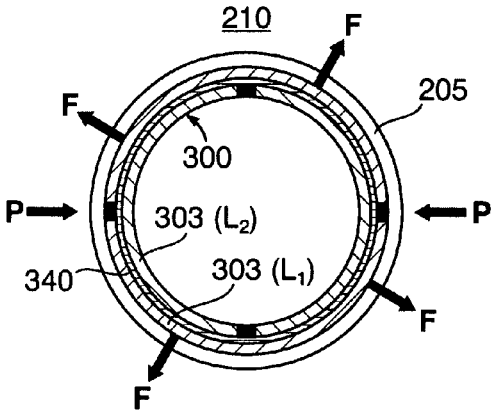
FIG. 3C is a sectional view through line 3-3 in FIG. 2, showing a supporting arrangement in accordance with another embodiment of the present invention.

FIG. 3C is a sectional view of compartment 210, through section line 3-3 in FIG. 2, showing yet another configuration for the support section. FIG. 3C shows the support structure 300 in the form of a multi-layered ring-shaped band, similar to the embodiment of FIG. 3B. In the embodiment of FIG. 3C, additional damping layers 340 are fitted between the shape memory alloy strips. A damping layer 340 may optionally be fitted between the vessel shell 205 and the first layer $L_1$. Additionally, each damping layer 340 may comprise a plurality of layers of different materials. The damping layers may comprise, silicone rubber, butadiene rubber, natural rubber, isoprene rubber, or chloroprene rubber, polyurethane, polyvinyl chloride, carbon black, calcium carbonate, titanium oxide, clay, talc, mica, alumina, or combinations thereof. Other known damping materials may also be incorporated. This multi-layered arrangement has many advantages including, the reduction of the effect of external hydrostatic loads, the inertial stiffening of the vessel, improved fatigue resistance, improved shock resistance, and improved acoustic damping. It should be noted that support structures as outlined above may also be utilized in high stress areas such as transition regions 215 and 225. Therefore, the support structures 350 may be any of the configurations outlined above with respect to the illustrations of FIGS. 3A-3C.

Figure 4:
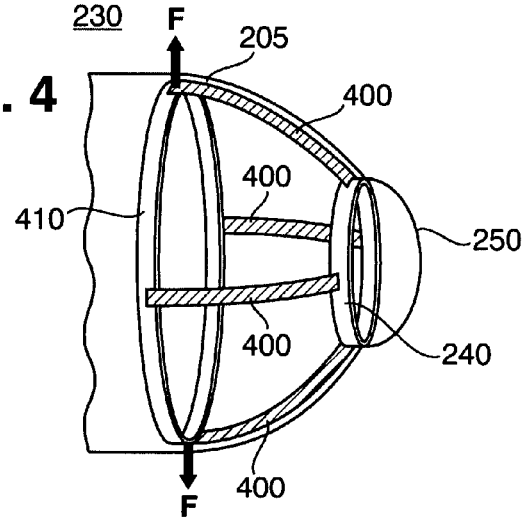
FIG. 4 is a perspective view of a supporting arrangement for a viewport in accordance with an embodiment of the present invention.

FIG. 4 is a perspective view of a supporting arrangement for a viewport in accordance with an embodiment of the present invention. FIG. 4 shows compartment 230, which includes a substantially circular viewport frame 240 and a viewport 250. The viewport may be flat, conical, hemispherical, or any other known shape. FIG. 4 also shows support structures 400, each being an arc-shaped band of a material made from shape memory alloys. Each supporting structure 400 is wedged between a ridged portion 410 and the viewport frame 240. Although FIG. 4 shows four supporting structures 400, the arrangement may include any desired number of supports. As the outlined with respect to the support structure in compartment 210, each support structure is formed from one or more substantially linear strips that are processed at a reduced temperature into an arc-shaped band. The arc-shaped band is then mounted in the vessel shell against the enclosed inner wall, heated to an operating temperature, after which each strip attempts to assume its original shape, thereby exerting an outward pressing force F against the vessel shell 205. The arc-shaped band also exerts a force against the viewport frame 240, thereby reinforcing the structure. Similar to the embodiments illustrated in FIGS. 3B and 3C, the arc-shaped bands may also be multi-layered and may also include additional damping layers disposed between the strips.

Figure 5A:
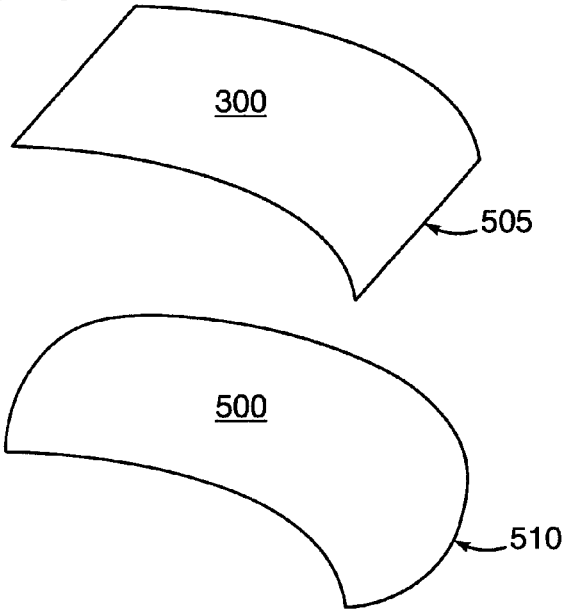
FIGS. 5A and 5B are perspective views of a supporting arrangement in accordance with an embodiment of the present invention.

FIG. 5A is comparative perspective view of a supporting arrangement according to an embodiment of the present invention. FIG. 5A shows the support structures 300 and 500 respectively, illustrating a structural difference between the support structures 300 applied in substantially cylindrical compartments, and support structures 500 applied in substantially spherical compartments. As shown at area 505, the ring-shaped band structure 300 is substantially flat along its outer surface. As shown at area 510, the ring-shaped band structure 500 is substantially curved along its outer surface. At a reduced temperature in the martensitic state, the band 500 is processed with a curved outer surface to compensate for the substantially spherical shape of the vessel shell in compartment 220. The band is then heated to enter into the austenitic state, where it attempts to recover its original shape, thereby creating a pressing force on the vessel shell.

Figure 5B:
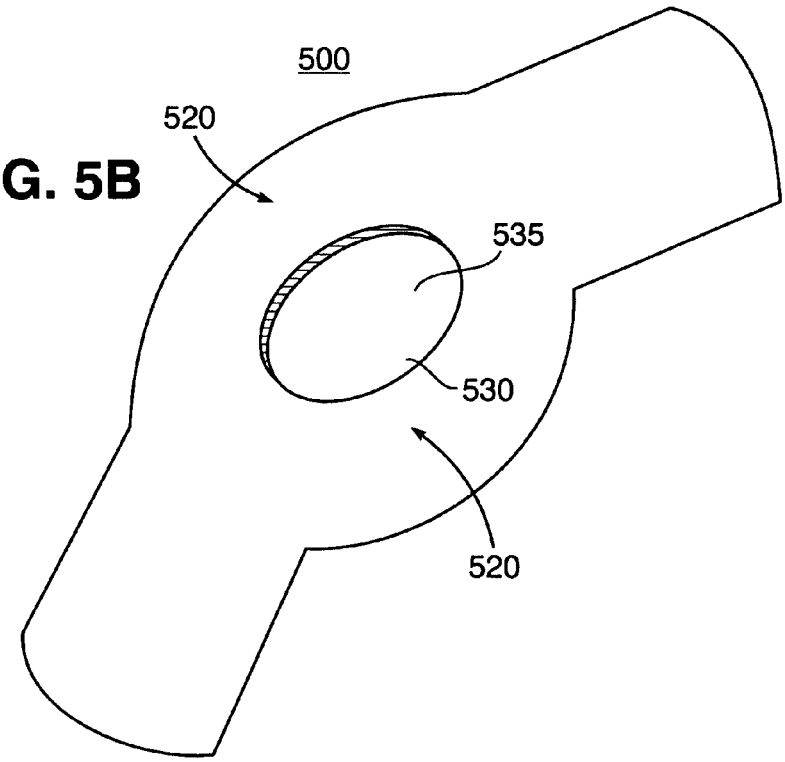

FIG. 5B shows an embodiment of the support structure 500 that reinforces a viewport. FIG. 5B illustrates a substantially circular viewport frame 530 that encompasses a viewport 535. The support structure 500 includes a longitudinally broadened portion 520 that encompasses the viewport frame and viewport. The broadened portion 520 reinforces the viewport region. Although FIGS. 2 and 5B show only one broadened portion 520, support structures 500 may include as many longitudinally broadened portions as desired to accommodate for a plurality of viewports. Apart from the slight structural differences outlined above, the support structures 500 may be any of the single or multi-layered configurations outlined above with respect to the illustrations of FIGS. 3A-3C. It should be noted that any desired number of support structures, with or without viewports, may be used in spherical compartments 220 and 230.

Figure 6:
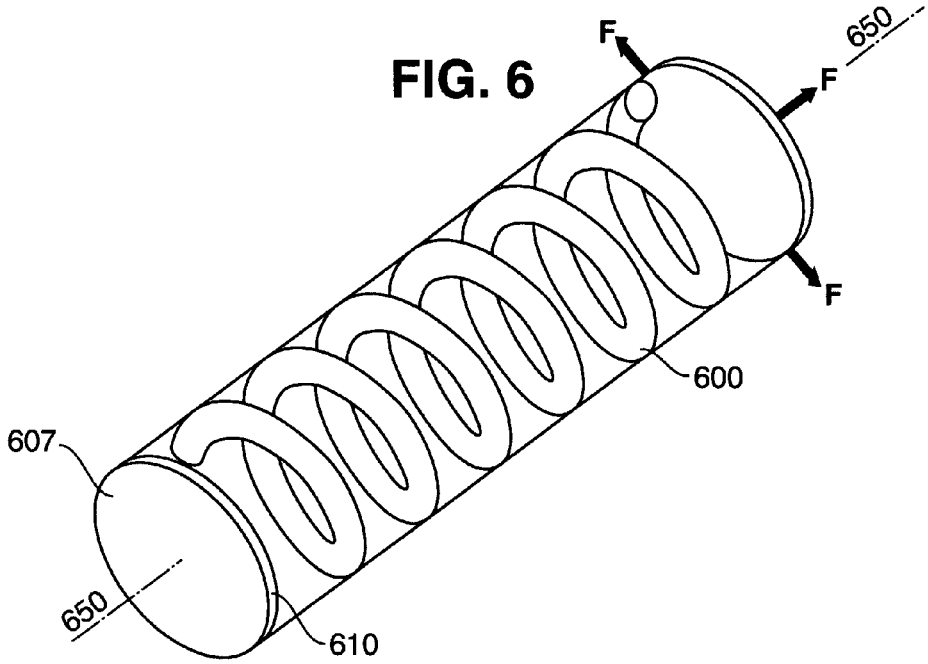
FIG. 6 is a perspective view of a supporting arrangement in accordance with another embodiment of the present invention.

FIG. 6 is a perspective view of a supporting arrangement in accordance with another embodiment of the present invention. FIG. 6 shows a substantially cylindrical coiled support structure 600 housed within vessel shell 610. Support structure 600, which is made from a shape memory alloy, may be used to reinforce a substantially cylindrical compartment, such as 210 in FIG. 2. The support structure 600 is positioned within the substantially cylindrical compartment so that a longitudinal axis of the cylindrical coil and a longitudinal axis of the compartment substantially coincide along 650, as shown in FIG. 6. Support structure 600 may be applied in two different embodiments. In a first embodiment, the cylindrical coil is manufactured to a size (including the diameter) that is larger than that of the substantially cylindrical compartment. The cylindrical coil is then cooled at a reduced temperature, wherein it enters into a martensitic state and is transformed to a cylindrical coil of reduced diameter, a diameter fractionally smaller than the diameter of the substantially cylindrical compartment. The cylindrical coil is then fitted into the substantially cylindrical compartment, and heated to an appropriate temperature to enter an austenitic state, where the cylindrical coil expands and presses against the enclosed inner wall 607 of the vessel shell 610. However, the vessel shell prevents the cylindrical coil from recovering to its original size, resulting in the cylindrical coil exerting a pressing and reinforcing force F as illustrated in FIG. 6. In the present embodiment, the shock absorbing ability of the support structure is enhanced due to the resilience of the coil that can be attributed to the shape of the cylindrical coil.

In another embodiment, the cylindrical coil is manufactured to a size that is substantially equal to the size of the substantially cylindrical compartment. The cylindrical coil is then cooled at a reduced temperature, wherein it enters into a martensitic state and is transformed to a cylindrical coil of reduced diameter, a diameter smaller than the diameter of the substantially cylindrical compartment. The cylindrical coil is then fitted into the substantially cylindrical compartment, and heated to an appropriate temperature to enter a superelastic state, where the cylindrical coil expands to a size about equal to its original size and presses against the enclosed inner wall 607 of the vessel shell with a force F. In addition to resistance to external compressive forces, the cylindrical coil provides inertial stiffening to the hull. In this embodiment, the cylindrical coil 600 offers additional shock absorbing capabilities because of the coil's spring-like characteristics in the superelastic state. In this state, the coil is able to withstand high stresses and still spring back to the original state. The shock absorbing ability of the support structure is further enhanced due to the resilience of the coil that can be attributed its shape. Additionally, one or more layers of damping materials as outlined in the embodiment of FIG. 3C may be inserted between the cylindrical coil 600 and the inner shell.

Figure 7:
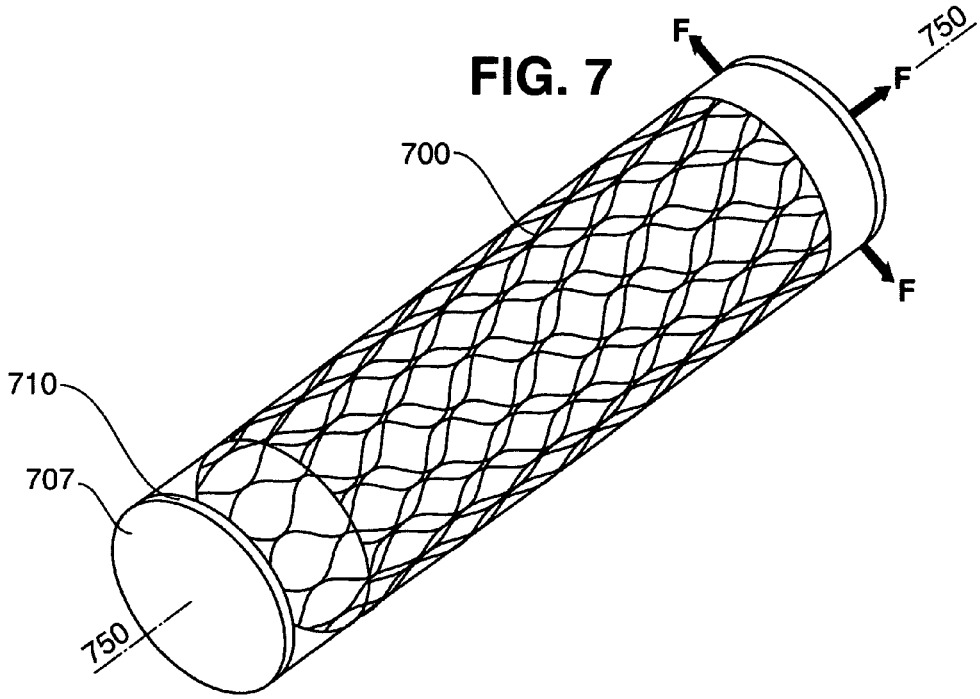
FIG. 7 is a perspective view of a supporting arrangement in accordance with another embodiment of the present invention.

FIG. 7 is a perspective view of a supporting arrangement in accordance with another embodiment of the present invention. FIG. 7 shows a substantially cylindrical stent support structure 700. Support structure 700, which is made from a shape memory alloy, may be used to reinforce a substantially cylindrical compartment, such as 210 in FIG. 2. The support structure 700 is positioned within the substantially cylindrical compartment so that a longitudinal axis of the cylindrical coil and a longitudinal axis of the compartment substantially coincide along 750, as shown in FIG. 7. Support structure 700 may be applied in two different embodiments. In a first embodiment, the net-like cylindrical stent is manufactured to a size that is larger than that of the substantially cylindrical compartment. The cylindrical stent is then cooled at a reduced temperature, wherein it enters into a martensitic state and is transformed to a cylindrical stent of reduced diameter, a diameter fractionally smaller than the diameter of the substantially cylindrical compartment. The cylindrical stent is then fitted into the substantially cylindrical compartment, and heated to an appropriate temperature to enter an austenitic state, where the cylindrical stent expands and presses against the enclosed inner wall portion 707 of the vessel shell 710. However, the vessel shell prevents the cylindrical stent from recovering to its original size, resulting in the cylindrical stent exerting a pressing and reinforcing force F as illustrated in FIG. 7. In the present embodiment, the shock absorbing ability of the support structure is enhanced due to the resilience of the stent that can be attributed to its spring-like shape.

In another embodiment, the cylindrical stent 700 is manufactured to a size that is substantially equal to the size of the substantially cylindrical compartment. The cylindrical stent is then cooled at a reduced temperature, wherein it enters into a martensitic state and is transformed to a cylindrical stent of reduced diameter, a diameter smaller than the diameter of the substantially cylindrical compartment. The cylindrical stent is then fitted into the substantially cylindrical compartment, and heated to an appropriate temperature to enter a superelastic state, where the cylindrical stent expands to a size about equal to its original size and presses against the enclosed inner wall portion 707 of the vessel shell with a force F. In this embodiment, the cylindrical stent 700 offers additional shock absorbing capabilities because of the stent's spring-like characteristics in the superelastic state. In this state, the stent is able to withstand large stresses and still spring back to the original shape. The shock absorbing ability of the support structure is further enhanced due to the resilience of the stent that can be attributed its shape. Additionally, one or more layers of damping materials as outlined in the embodiment of FIG. 3C may be inserted between the cylindrical stent 700 and the inner shell.

In each of the above described embodiments, the shape memory alloy materials may include, nickel-titanium based alloys, indium-titanium based alloys, nickel-aluminum based alloys, nickel-gallium based alloys, copper based alloys such as copper-zinc alloys, copper-aluminum alloys, copper-gold, and copper-tin alloys. Alloys such as gold-cadmium based alloys, silver-cadmium based alloys, indium-cadmium based alloys, manganese-copper based alloys, iron-platinum based alloys, iron-platinum based alloys, iron-palladium based alloys, may also be used. Variations in the combinations and compositions of these alloys may also be employed to provide desired results. For instance, the temperature at which the shape memory alloy recovers its high temperature configuration can be adjusted by slight changes in the composition of the alloy and through heat treatment. In nickel-titanium shape memory alloys for example, the temperature for entering into the austenitic state can be manipulated from above about 100 degrees Celsius to below about −100 degrees Celsius by manipulating the composition of the nickel-titanium. It should be noted that in each of the above described embodiments, in addition to resistance to external compressive forces, the support structures provide inertial stiffening to the hull. Additionally, when non-magnetic shape memory alloys are employed in the present invention, the supporting arrangement includes the benefit of reduced magnetic susceptibility.

What has been described and illustrated herein are preferred embodiments of the invention along with some variations. The terms, descriptions and figures used herein are set forth by way of illustration only and are not meant as limitations. For example, the strips and damping layers as represented in FIGS. 3A-3C are not drawn to scale. The supporting arrangement disclosed may also be applied in vessel hulls that have streamlined or teardrop shapes. Flat ring-shaped bands such as supports 300 may be utilized in substantially spherical sections. Additionally, the general supporting arrangement may also be applied to vessels in other environments that experience large hydrostatic pressures. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. An underwater vessel supporting arrangement for counteracting compressive loads at an operating temperature, the underwater vessel supporting arrangement comprising:

an underwater vessel having a vessel shell comprising a substantially cylindrical subdivision having an enclosed inner wall portion; and one or more support bands for exerting an outward pressing force on the vessel shell at the operating temperature, each of the one or more support bands comprising a shape memory alloy having an original substantially linear shape at the operating temperature, each of the one or more support bands contacting the enclosed inner wall portion of the substantially cylindrical subdivision, wherein at the operating temperature each of the one or more support bands is restricted to a non-linear and a substantially arc shape that corresponds to the curvature of the inner wall portion of the substantially cylindrical subdivision, the inner wall portion of the substantially cylindrical subdivision preventing the recovery of the one or more support bands to the original substantially linear shape, each restricted support band thereby exerting an outward pressing force on the inner wall portion of the substantially cylindrical subdivision.

2. The underwater vessel supporting arrangement of claim 1, wherein each substantially arc-shaped band comprises a multi-layered arrangement with a plurality of shape memory alloy strips forming concentric rings, the shape memory alloy strips arranged in a staggered overlapping manner.

3. The underwater supporting arrangement of claim 2, wherein one of the plurality of shape memory alloy strips has a greater stiffness than the other shape memory alloy strips in the multi-layered arrangement.

4. The underwater vessel supporting arrangement of claim 3, further including one or more acoustic and vibration damping layers sandwiched between the shape memory alloy strips.

5. The underwater vessel supporting arrangement of claim 2, further including one or more acoustic and vibration damping layers sandwiched between the shape memory alloy strips.

6. The underwater vessel supporting arrangement of claim 4, wherein the vessel shell further comprises at least one substantially spherical subdivision attached to the substantially cylindrical subdivision, the at least one substantially spherical subdivisions having an enclosed inner wall portion and a viewport therein, the underwater vessel supporting arrangement further comprising one or more additional support bands, each of the one or more additional support bands comprising a shape memory alloy having an original substantially linear shape at the operating temperature, each of the one or more additional support bands contacting the enclosed inner wall portion of the substantially spherical subdivision, wherein at the operating temperature each of the one or more support bands is restricted to a non-linear and a substantially arc shape that matches the curvature of the inner wall portion of the substantially spherical subdivision preventing the recovery to the original substantially linear shape, each restricted support band thereby exerting an outward pressing force on the inner wall portion of the substantially spherical subdivision.

7. The underwater vessel supporting arrangement of claim 6 wherein the one or more support bands are laterally spaced within the enclosed inner wall portion of the substantially cylindrical subdivision of the vessel shell.

8. The underwater vessel supporting arrangement of claim 2 wherein the one or more support bands are laterally spaced within the enclosed inner wall portion of the substantially cylindrical subdivision of the vessel shell.

* * * * *